US006034601A

United States Patent [19]

Barrieau et al.

[11] Patent Number: 6,034,601

[45] Date of Patent: Mar. 7, 2000

[54] METHOD AND APPARATUS FOR DETERMINING PROPER INSTALLATION OF ALARM DEVICES

[75] Inventors: Mark P. Barrieau, Baldwinville; Paul H. Maier, Jr., Athol; Mike A. Faulkner, Shrewsbury, all of Mass.

[73] Assignee: Simplex Time Recorder Company, Gardner, Mass.

[21] Appl. No.: 09/028,384

[22] Filed: Feb. 24, 1998

[51] Int. Cl.[7] ..... G08B 29/00

[52] U.S. Cl. ..... 340/514; 340/505; 340/661; 324/525; 324/537

[58] Field of Search ..... 340/505, 506, 340/511, 514, 825.06, 825.07, 825.08, 661, 662, 663; 324/512, 525, 537

[56] References Cited

U.S. PATENT DOCUMENTS

| | | | |
|---|---|---|---|
| 4,489,312 | 12/1984 | Yoshizaki | 340/514 |
| 4,777,473 | 10/1988 | Weston et al. | 340/514 |
| 4,947,162 | 8/1990 | Kimura | 340/825.08 |
| 5,247,245 | 9/1993 | Nelson | 324/133 |
| 5,475,363 | 12/1995 | Suzuki et al. | 340/506 |
| 5,565,852 | 10/1996 | Peltier et al. | 340/632 |
| 5,594,417 | 1/1997 | Morita | 340/506 |

*Primary Examiner*—Daryl Pope
*Attorney, Agent, or Firm*—Hamilton, Brook, Smith & Reynolds, P.C.

[57] ABSTRACT

A method and apparatus detect devices on a line in an alarm system that have been assigned a common or duplicate address, or that are located beyond the maximum allowable wiring distance on the line, or that are poorly connected to the line thus providing weak answers to communications from the control panel. The method and apparatus operate by polling suspect addresses of devices on the line while adjusting the sensitivity of the receiver. The sensitivity of the receiver is lowered by an amount corresponding to the test being performed. In duplicate address testing, the sensitivity of the receiver is lowered by an amount such that a single response from only one device having the polled address will not be sensed, but combined responses from more than one device having the same address are sensed. In weak answer testing, the sensitivity of the receiver is lowered by an amount such that a single response from a device securely connected to the line and within the wiring distance limits is detected, but a device un-securely connected to the line or beyond the maximum wiring distance is not detected.

32 Claims, 4 Drawing Sheets

METHOD AND APPARATUS FOR DETERMINING PROPER INSTALLATION OF ALARM DEVICES

BACKGROUND OF THE INVENTION

In a typical alarm system within a building, such as a fire or burglar alarm system, many types of sensors, detectors, lights, strobes, sounders and other associated devices may be located throughout the building as part of the system. Groups of these devices are often wired together along a pair of bidirectional communication lines. A group of such devices on a pair of lines is often referred to as a "line of devices". Many lines of devices can connect back to a control panel that controls the overall operation of the alarm system. A line of devices is usually associated with a certain zone of the building and/or a certain type of device. For example, one floor of a multi-story building may have all of its smoke detectors wired together on a line that connects back to the control panel.

Each device on a line may be individually addressed from the control panel. Individual addressing of devices allows a single device to indicate an alarm condition at a specific location on a line, and provides selective operation of specific devices, and can also be useful for alarm system fault diagnosis and/or individual device testing. Device addresses may be manually set in each device, for example, by configuring DIP switches or jumpers internal to the device to reflect a unique address code. However, during the installation of many devices, an installer may accidently configure the same address in more than one device. The problem of duplicate addressing may cause a failure in device communications resulting in incorrect operation of the alarm system.

Schemes have been developed to automatically and remotely assign addresses to devices in a predetermined order from the control panel to prevent duplicate address problems. For example, in Morita, U.S. Pat. No. 5,594,417, an alarm system is disclosed that includes an address setting unit in the control panel which sends special commands to devices in order to set device addresses. Each device initially contains a unique factory preset address. After installation, the address setting unit assigns unique address codes to each device and tracks allocated addresses. New devices may be added or devices may be removed and the address setting unit can use communications to electronically reset and reassign new addresses. Due to its automated nature, the address assignment scheme in Morita does prevent assignment of a new device address to more than one device. However, the solution is complicated since each device must contain a mechanism to set its own address. Moreover, Morita uses specialized devices, thus preventing alarm systems equipped with devices that use manual address setting mechanisms to benefit from the features of Morita.

During alarm system device installation, it is also important to properly connect and wire the devices to the lines. An improperly wired device may not have enough electrical contact with a line to allow for effective communications with the control panel. Devices that are poorly wired may become difficult to communicate with over time due to aging of the electrical connection, corrosion, dirt and/or dust build up which increases resistance in the line connection.

Various ways have been proposed to ensure that devices are properly connected to the lines. For instance, Weston et al., U.S. Pat. No. 4,777,473, discloses an addressable device alarm system in which each device contains an internal alarm condition resistor. When the control panel sends a message to a specific device address, the device having that address connects its internal alarm condition resistor to the line and the control panel measures the resistance on the line, including the alarm condition resistor in the device. If the resistance measured is as expected, the device is determined to be correctly wired to the line. However, as in Morita, devices in Weston require special circuitry to engage the internal resistor with the line when instructed by the control panel.

SUMMARY OF THE INVENTION

Other problems may occur in alarm system installation, operation and configuration which are not solved in known systems, such as those noted above. For example, when wiring an alarm system, a problem may occur when a detector or other device is wired too far away from the control panel, thus providing communications signals which are weaker than specifications of the alarm system require. The distant detector may appear to be operable under normal non-alarm conditions, or when polled for its existence on the line. However, under noisy conditions, such as during an alarm period when many detectors may be sending signals on the line, the distant detector may provide a signal which is too weak to overcome increased line resistance or noise on the line.

Accordingly, it would be desirable to determine which, if any, devices on a line are located at a distance beyond alarm system specifications, or if any devices are poorly installed or weakly wired to the line, through weak answer detection. Weak wiring may include a corroded connection, for example, which degrades the device communications with the control panel.

The problem of duplicate addresses, as noted above, must also be diagnosed and fixed before correct operation of the alarm system can occur. Hence, it would also be desirable to detect when two or more devices having the same address exist on a line and to determine which address is duplicated and which devices contain the duplicate addresses and where those devices are located.

To solve these problems, the present invention provides a method and apparatus that may be implemented in the control panel of an alarm system having addressable devices. The invention recognizes that responses from devices that are improperly wired may be detected and diagnosed using a special receiving apparatus and method. The receiving apparatus has the ability to adjust receiving sensitivity in order to perform either weak answer detection or duplicate address detection. In operation, the apparatus polls devices on an address-by-address basis. The responses sent from the devices responding to the polls are received at the receiver of the invention and compared with a reference at the reduced sensitivity of the receiver.

In duplicate address detection according to this invention, the receiver sensitivity is lowered by an amount such that a single response from a single properly connected device having the polled address will not be sensed; whereas, combined responses from more than one device having the polled address will be sensed. Thus, in duplicate address detection, if a response to a poll is sensed, then two or more devices must have the polled address and address correction is required.

In weak answer detection, the receiver sensitivity is lowered by a somewhat lesser amount than duplicate address detection such that a response from a polled device that is wired too distantly from the control panel, or one that is poorly connected to a line, will not be sensed; whereas, a response from a securely wired device located within the distance requirements on the line will be sensed. Thus, in weak answer detection, if no response to a poll is detected, the address polled represents a weak answer device needing a wiring or line location correction.

The invention determines improper installation of a plurality of addressable devices coupled to a line in an alarm system. A poll transmission circuit coupled to the line polls individual addresses of the addressable devices. A receiving circuit is also coupled to the line and detects a response on the line from at least one addressable device responding to a poll message generated by the poll transmission circuit.

The receiving circuit has a normal sensitivity used for sensing normal non-test communications with devices on the line and a reduced sensitivity that is reduced in relation to the normal sensitivity to detect devices improperly installed on the line. The detection is based upon a comparison of the response and a reference at the reduced sensitivity, while in a device testing mode, such as one of either weak answer or duplicate address testing modes.

Sensitivity of the receiving circuit, for example, may be adjusted or lowered by switching in a specific resistor in parallel with a reference resistor providing a reference voltage, depending upon the testing mode. As such, the overall reference voltage is lowered.

In a more specific example of duplicate address testing, a single device response will sink a current on the line providing a certain voltage drop, but a duplicate response will sink twice as much current and the voltage will drop even more. As such, by lowering the receiver sensitivity (i.e. lowering the reference voltage) to detect only those duplicate responses having very low voltages, single responses will not be detected or sensed by the receiving circuit. Hence, in duplicate addressing, sensed responses indicate a duplicate address problem for the address polled. In weak answer testing, the reference voltage determining sensitivity of the receiver is again lowered, but to a lesser degree. Responses from devices that cannot draw a minimum required current will not lower the response voltage enough to cross the reduced sensitivity threshold and will not be sensed. Accordingly, weak answer polls that do not get a sensed response in return signify an address of a device that is either insecurely wired to the line or is located too distantly from the control panel.

The receiving circuit includes a response amplification circuit coupled to the line which receives a response and provides a measurement of the response. A sensitivity selection circuit provides an adjustable sensitivity reference voltage that determines the normal and reduced sensitivity modes of the receiving circuit. The sensitivity reference voltage has a first value when the receiving circuit is operating in normal sensitivity and a second value when the receiving circuit is operating in reduced sensitivity.

A comparator circuit is also provided for receiving the measurement of the response and receiving the sensitivity reference voltage. The comparator circuit determines, while the receiving circuit is in a device testing mode, if the measurement of the response overcomes the reduced sensitivity of the receiving circuit as defined by the sensitivity reference voltage. In this manner, improper device installation may be detected.

Advantageously, by reducing the sensitivity of the receiving circuit, the same circuit used for receiving normal communication from devices may be used to test the devices for duplicate addresses or weak answers reflecting problems in location or wiring.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
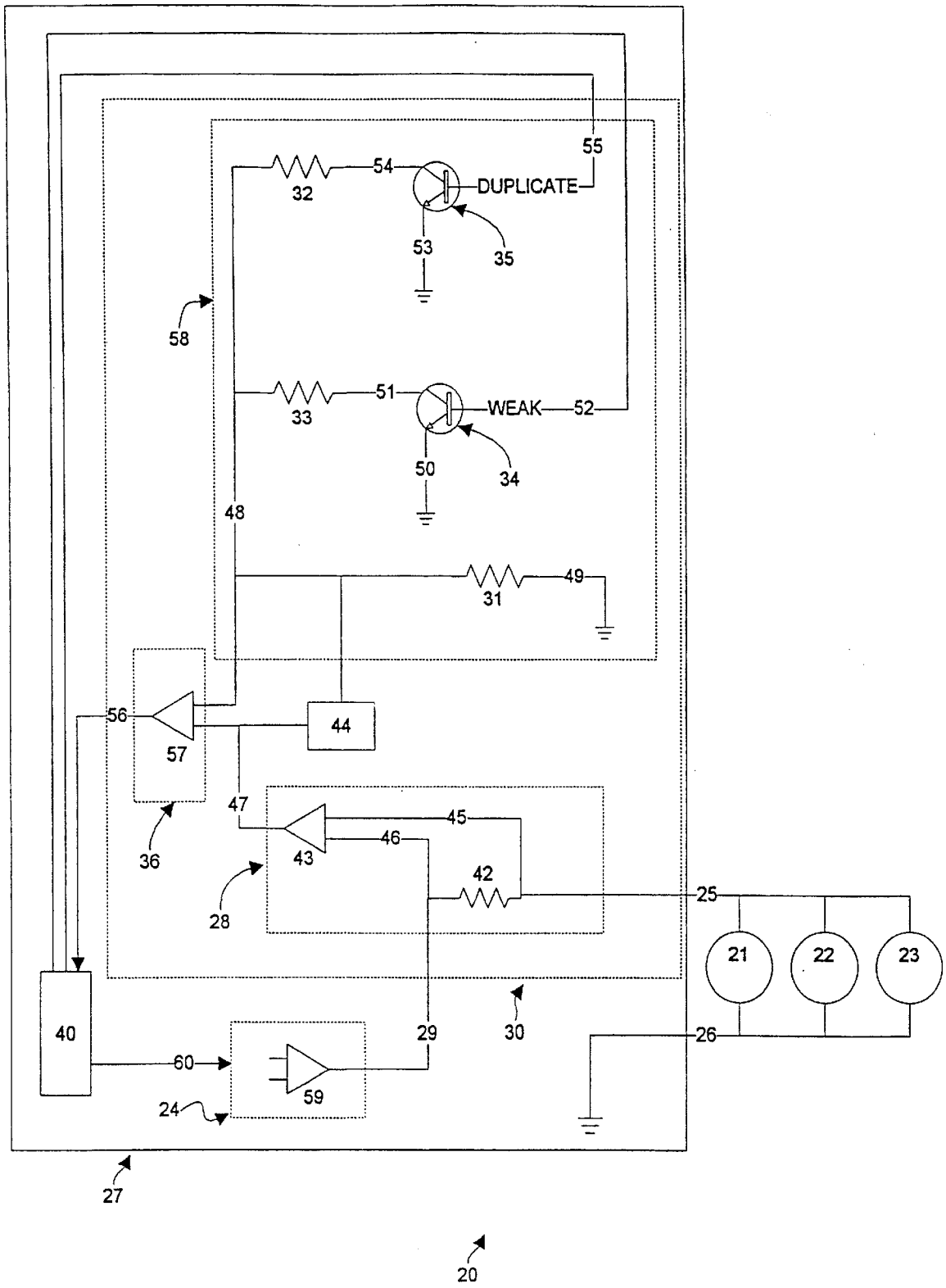
FIG. 1 is an illustration showing an example configuration of the main internal components of an alarm system according to this invention.

FIG. 1 illustrates a simplified portion of an example alarm system 20 configured with the main components of the present invention. Alarm system 20 may be, for example, a fire or burglar alarm system used within a building. Devices 21, 22 and 23 are each electrically coupled to bidirectional communication lines 25 and 26, which connect back to circuitry within control panel 27. Devices 21, 22 and 23 may be, for example, smoke detectors, heat sensors, motion sensors, strobe lights, horns or other types of sensing and annunciator devices typically found in such systems. The devices are referred to as being wired to a single "line", which collectively refers to lines 25 and 26. Each device 21, 22 and 23 is individually addressable by the control panel 27, allowing communication to take place between any one device and the control panel 27.

Devices on a line may be of the same type, such as a line of smoke detectors, or a line may contain different devices, such as sprinker heads and smoke detectors. In any event, devices are distributed along the line at strategic points within a zone of the building in order to ensure detection of smoke or distribution of water, as in these examples, anywhere within that zone. Addresses of each device are typically manually configured by physically setting DIP switches or jumpers within each device. The lines 25 and 26 may be any type of communications line or media, including the power supply lines for the device. In the latter case, communication may take place using a frequency or protocol which does not interfere with the supply of power to the devices.

The example alarm system 20 in FIG. 1 illustrates only one line of devices and only a limited amount of circuitry in the control panel 27 for simplicity and ease of description of this invention. In alarm systems covered within the scope of this invention, many separate lines containing various types of devices may be coupled to the control panel 27, and other circuitry may exist in such systems as well. FIG. 1 has been abstracted to show the main components of the invention and to simplify description of the invention. The illustration of FIG. 1 is conceptual in nature and focuses on the main principles of the invention.

In FIG. 1, control panel 27 can be a combination of electrical control circuitry, microprocessors and/or software used to control alarm system 20. The control panel 27 performs functions such as testing devices 21, 22 and 23 and lines 25 and 26 for faults, activating and deactivating specific devices, and monitoring the devices for alarm conditions such as smoke or fire throughout a building.

Microprocessor 40 controls the overall communications with devices 21, 22 and 23, via poll transmission circuit 24. To send communications from the control panel 27 to one of devices 21, 22 or 23, microprocessor 40 sends a series of signals on line 60 to poll transmission circuit 24. The signals on line 60 represent a poll message intended to be detected by one of the devices 21, 22 or 23. The poll message may, for example, contain the unique address of one of the devices 21, 22 or 23. Amplifier 59, which continuously supplies power to devices 21, 22 and 23, receives the poll message signals on line 60 and varies the voltage on lines 29 and 25 in response to these signals in order to transmit the poll message to each device 21, 22 and 23.

The specific device addressed on line 25 senses the poll message and can provide a response, for example, by repeatedly sinking the current on line 25 through an internal resistor (not shown) coupled to grounded line 26, according to a predetermined response pattern. The response current changes on line 25 are detected in receiving circuit 30 by amplification circuit 28 containing resistor 42, which forms a current sensor which converts the response current changes on line 25 to voltage differences on lines 45 and 46. When current is sunk during a device response, the voltage across resistor 42 increases accordingly. The voltage differences on line 45 and 46 are then amplified by amplifier circuit 43 and are output as a measurement of the response value for that responding device on line 47.

In order for the microprocessor 40 to sense a normal response from a device at sense output 56, the measurement of the response on line 47 is compared with a sensitivity reference voltage on line 48 by comparator circuit 36. As shown in FIG. 1, the normal sensitivity reference voltage on line 48 is produced from reference resistor 31 coupled to ground via line 49 and the reference voltage supply provided as output from filter 44 onto line 48. Aside from the rapid voltage changes characteristic of a response, line 47 generally maintains a measurement of the supply reference voltage which is constantly output from the response amplification circuit 28, due to a supply reference voltage from the poll transmission circuit 24 present on lines 29 and 46. Filter 44 continuously averages the measurement of the supply voltage present on line 47 and outputs this average as the sensitivity reference voltage supply which is governed or determined during normal (i.e. non-test) operation by the voltage through resistor 31. Filter 44 may contain, for example, circuitry including an RC circuit having a large time constant that monitors and stores the average voltage present on line 47 which results from the continuous power supplied to devices 21, 22 and 23 via poll transmission circuit 24. Accordingly, sensitivity remains constant even as average voltage on the line fluctuates.

The continuous line current supplied to devices 21, 22 and 23 by amplifier 59 may be, for example, ½ of an Amp, but depending on the normal current draw of devices on lines 25 and 26, that current may vary over a long time period by as much as 100 mAmps or more. The current variations representing poll and response messages which are sufficient enough for device communications may, for example, be only 120 mAmps of additional current. The filter 44 allows those short term changes to be distinguished from long term changes in normal current draw without change in sensitivity.

Thus, in normal circuit operation, when no communication is taking place between devices 21, 22 and 23 and the control panel 27, the approximately ½ amp of current on lines 29, 46 and 25 resulting from power supplied to the devices, and therefore the voltage on line 47 and also the sensitivity reference voltage on line 48 are relatively constant. However, during periods of communication with devices 21, 22 or 23, rapid changes of 120 mAmps or more in the current on line 25 occur due to polling and device responses. These rapid changes in current are reflected as rapid changes (e.g., drops) in voltage output from response amplification circuit 28 onto line 47. However, since the filter 44 has a large time constant, the quick voltage changes due to communication (i.e., polls and responses) are not reflected as changes in the sensitivity reference voltage on line 48.

To produce sense output 56 received by the microprocessor 40, comparator 57 in comparator circuit 36 determines if measurements of the response, appearing as rapid voltage changes on line 47, overcome or cross the threshold of the receiver sensitivity that is determined from the stable average sensitivity reference voltage that is continuously supplied on line 48 via filter 44 and is determined by the resistance value of resistor 31. Sense output 56 thus supplies a signal representing only those signals on line 47 which overcome the sensitivity of comparator 57, as determined by the sensitivity reference voltage on line 48 supplied from filter 44 and resistor 31. Since the microprocessor 40 knows, due to its control of polling, when to expect responses from devices, the microprocessor 40 can interpret the sense output 56 during expected response times.

The sensitivity reference voltage on line 48 produced from filter 44 and resistor 31, in effect, determines the sensitivity of the receiving circuit 30, since the reference voltage on line 48 is used as a basis for detecting and comparing the voltage changes on line 47. This principle allows the same receiving circuit 30 that is used for normal communications with devices, as explained previously, to also be used for duplicate address testing and weak answer testing according to the present invention.

To initiate either duplicate address testing or weak answer testing, microprocessor 40 sends a test poll message indicating either a duplicate address test or a weak answer test. The test poll message also contains an address of one of addressable devices 21, 22 or 23. Any device attached to line 25 having an address corresponding to the address contained in the test poll message receives the poll message and returns a response value (i.e. sinks current) according to a predetermined test response value or pattern.

Before the response is received from the polled device, that is, before the measurement of the response output from response amplification circuit 28 is placed onto line 47 as input into the comparator circuit 36, the sensitivity of receiving circuit 30, defined by the sensitivity reference voltage on line 48, is reduced. The amount of receiver sensitivity reduction depends upon which of either weak answer or duplicate address testing mode is initiated. For duplicate address detection, the sensitivity is reduced such that a single device response will not produce a detectable signal at sense output 56, whereas two simultaneous device responses will sink enough current to drop the line voltage enough to produce a sensed output in relation to the reduced sensitivity reference voltage. In weak answer testing, the sensitivity is reduce to a minimum acceptable level, and any responses not sensed or detected due to the responding device not being able to drop the line voltage enough will indicate a unsecured or distant connection for the device addressed in the test poll message.

To reduce or lower the overall receiver sensitivity used when measuring device response values in receiving circuit 30, microprocessor 40 activates either one of terminals 55 (labeled DUPLICATE) or 52 (labeled WEAK), depending upon the test being performed. Activating either terminal 55 or 52 in sensitivity selection circuit 58 turns on the respective switching mechanism 35 or 34 in order to couple one of the first 32 or second 33 selectable resistance values to ground, thus providing another completed circuit (besides the one through resistor 31) for the sensitivity reference voltage supplied from filter 44. The selected resistance value 32 or 33 is thus placed in parallel with reference resistance value 31, with respect to the reference input (i.e. line 48) of comparator circuit 36. That is, depending upon which test is being performed, one of the selectable resistance values 32 or 33 is placed in parallel combination with reference resistance value 31, which decreases the sensitivity reference voltage on line 48, that is input into comparator circuit 36, and therefore increases the required current drop of a response and the corresponding voltage drop on line 47 that is required to cross the now reduced sensitivity of detection.

Specifically, during initiation of duplicate address testing in the invention, DUPLICATE terminal 55 is switched on by microprocessor 40 in order to activate duplicate address switching mechanism 35 which connects the terminal 53 coupled to ground, through the first selectable resistance value 32, to line 48. Duplicate address switching mechanism 35 may be, for example, a transistor or other electrical switching device. Reference resistance value 31, which is always coupled between line 48 and ground 49 for normal communications, as previously explained, is then placed in parallel with the first selectable resistance value 32 upon activation of DUPLICATE terminal 55. The parallel resistance values 31 and 32 decrease the sensitivity reference voltage present on line 48 which reduces the sensitivity of comparator 57 in comparator circuit 36. This in turn will require the measurement of the response on line 47 to have a greater voltage drop in order for the response to be sensed at sense output 56 of comparator circuit 36.

The principle behind lowering the sensitivity in duplicate address testing is that if two or more of devices 21, 22 or 23 have the same address, they both respond to the test poll message. The simultaneous dual responses sinks twice as much current on line 25, thus producing an even lower voltage for the measurement of the response on line 47. The lower measured response is within the decreased range of voltage detection as determined by the reduced sensitivity threshold of comparator 57 and therefore produces a sensed output on sense output 56. However, if only one device has the address of the test poll message, the single response does not sink enough current to lower the voltage on line 47 enough to cross the reduced sensitivity threshold of the receiving circuit 30 and therefore does not produce a detected signal at sense output 56.

In a similar manner, when microprocessor 40 initiates weak answer detection testing, the WEAK terminal 52 is activated to turn on weak answer switching mechanism 34, thereby connecting grounded terminal 50, through the second selectable resistance value 33, to line 48. In doing so, reference resistance value 31, which is always active on line 48, is placed in parallel with the second selectable resistance value 33, thereby adjusting or lowering the threshold and reducing the sensitivity of comparator 57 in comparator circuit 36. The sensitivity reference voltage on line 48 is set so that a device response must produce a minimum required current draw to produce a corresponding minimum voltage drop in the measurement of the response voltage on line 47.

When the measurement of the response appears from the response amplifier circuit 28 on line 47 in response to a weak answer test poll message, the comparator circuit 36 requires at least a minimum voltage drop in the measurement of the response in order to cross the adjusted (i.e. lowered) threshold of comparator 57 and to produce a signal on sense output 56. If the response from the device is too weak, indicating poor wiring or a distantly located device, the measurement of the response voltage on line 47 will not drop enough to cross the reduced sensitivity threshold of the receiving circuit 30 and will not produce a sensed signal at sense output 56.

Hence, in weak answer detection, based on the presence or not of a signal on sense output 56, the microprocessor 40 can determine if the address polled is for a device having a weak connection to lines 25 or 26, or if the response value is for a device 21, 22 or 23 wired too distantly from the control panel 27. If a signal exists at sense output 56 in response to a poll message, the polled device is wired and located within alarm system specifications. If no response is sensed, the device having the address in the poll message needs to be rewired or relocated.

This invention shown in FIG. 1 is advantageous since it can eliminate the need for an entirely separate fault testing circuit in an alarm system. The regular receiving circuit used for normal data communications with devices can, as explained, also be used to detect faults by providing the sensitivity selection circuit.

Figure 2:
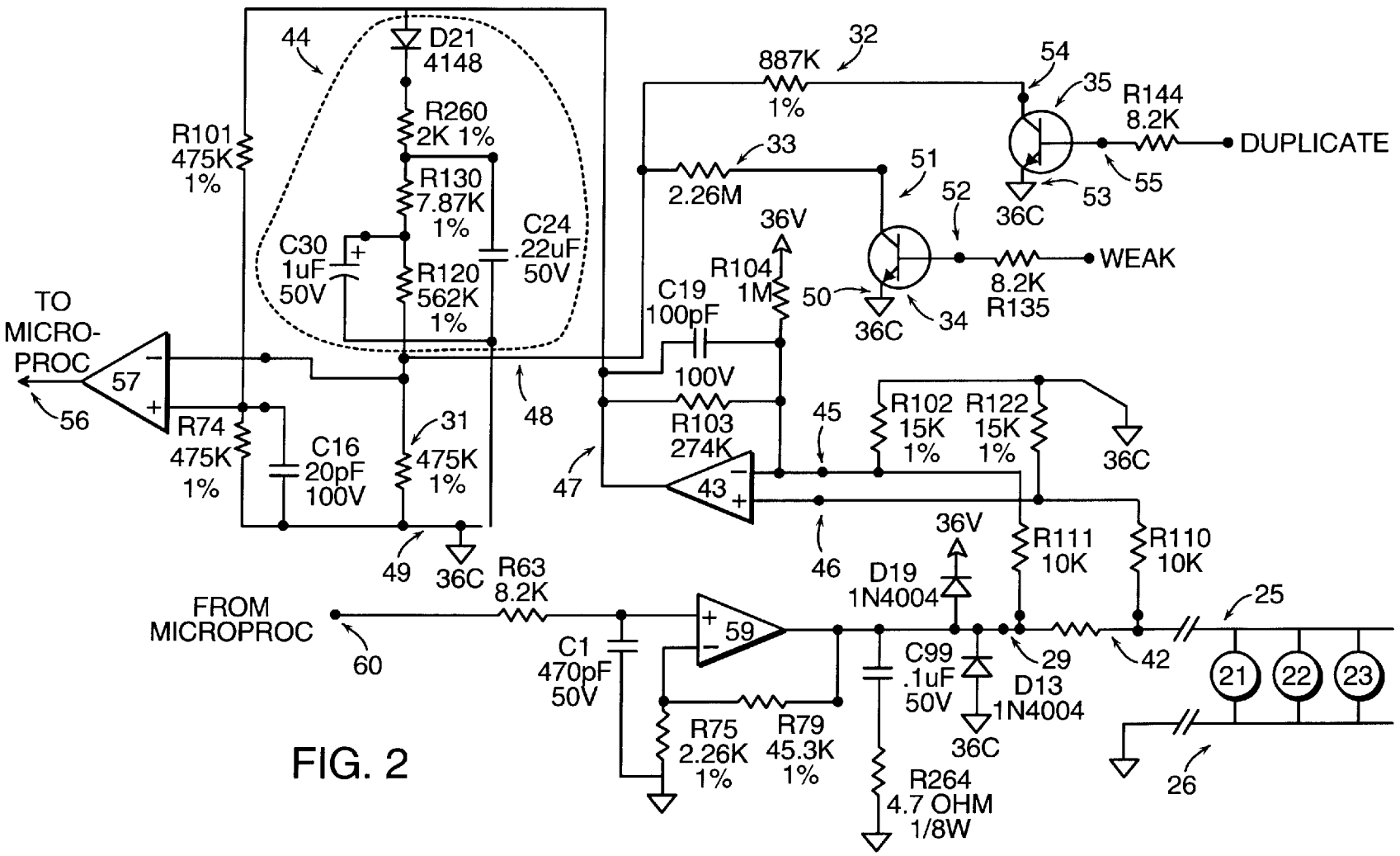
FIG. 2 is an illustration of a more detailed embodiment of an alarm system circuit according to this invention.

FIG. 2 shows a more detailed embodiment of the invention. In FIG. 2, the numbering of the main circuit components of the invention outlined with respect to FIG. 1 has been transferred over to similar circuit components in FIG. 2, in order to assist in understanding the operation of the circuit. The operation of the circuit in FIG. 2 is generally the same as that of FIG. 1, however, additional components such as filters and spike suppressors have been included to clarify circuit operation. Certain components of the circuit shown in FIG. 2 are also labeled with their respective electrical characteristics, such as the Ohms rating of certain resistors, for example, to further assist in understanding the invention.

In FIG. 2, transmitter 59, corresponding to transmitter 59 in poll transmission circuit 24 of FIG. 1, receives poll messages for devices on line 60 from the microprocessor (not shown in FIG. 2). Generally, the poll transmission circuit in FIG. 2 comprises all circuitry attached to the left of point 29, including spike suppression diodes D19 and D13, the RC filter formed by resistor R264 and capacitor C99, and the feedback loop to the transmitter 59 formed by resistors R79, R75 and capacitor C11. Transmitter 59 can provide, for example, approximately ½ Amp of continuous current to power devices 21, 22 and 23 on line 25. Transmitter 59 alters the supply voltage by a fixed percent in order to transmit the poll message to devices 21, 22 and 23 over line 25.

In response to poll messages, responses from devices 21, 22 and/or 23 are returned on line 25 where resistor 42 converts the response current into voltages which pass through 10K resistors R111 and R110 which combine with resistors R102 and R122 to act as voltage dividers for the voltage on lines 45 and 46, which serve as inputs to operational amplifier 43. A filter circuit made up of resistors R103, R104 and capacitor C19 provides a feedback filter which helps set and smooth the average voltage level input into op-amp 43, such that op-amp 43 outputs, during periods of non-communication, a measurement of the supply reference voltage received on line 29 as a result of the power supplied to the devices 21, 22 and 23 from transmitter 59. Upon reception of a response, op-amp 43 varies the voltage output to line 47 to produce the measurement of the response value onto line 47. The measurement of the response value on line 47 is slightly smoothed as well before being input into comparator 57 by the filter made up of resistor R74 and capacitor C16 located adjacent to the input of line 47 for comparator 57.

During normal receiving circuit operation in FIG. 2, while not in either weak answer or duplicate address testing mode, reference resistor 31 which is coupled to ground 36C (53 in FIG. 1), in conjunction with the low pass filter 44 made up from resistors R260, R130, R120, capacitors C30 and C24, and diode D21, ensures that the sensitivity reference voltage on line 48 input into comparator 57 is a stable average value. The sensitivity reference voltage is thus obtained or derived by filter 44 averaging the measurement of the supply reference voltage continuously present on line 47. This voltage is derived from the reference supply current provided to the addressable device 21, 22 and 23 and the receiving circuit (30 in FIG. 1) by the transmitter S9 (poll transmission circuit 24 in FIG. 1).

Just as explained with respect to FIG. 1, when the microprocessor initiates polling of devices 21, 22 or 23 in order to test for either duplicate addresses or weak answers from one of these devices, depending upon which test is to be performed, the microprocessor also turns on either duplicate address switching mechanism 35, or weak answer switching mechanism 34, via the respective WEAK terminal 55, or the DUPLICATE terminal 52.

By asserting either the WEAK or DUPLICATE terminal, one of respective selectable resistors 32 or 33 is placed in parallel with reference resistor 31, just as explained for FIG. 1, thus decreasing the reference voltage on line 48 and reducing the sensitivity of comparator 57.

Accordingly, when the measurement of the response is received for comparison on line 47 from operational amplifier 43, line 48 contains a reduced sensitivity reference voltage, as compared with the sensitivity reference voltage used to set normal receiver sensitivity during normal device communications. As such, the sensitivity of the comparator is reduced and requires a lower measurement of the response voltage on line 47 from the device or devices responding to a poll in order to cross the lower threshold of the comparator circuit 57. If the threshold is crossed, the sense output 56 of the comparator circuit 57 then produces a signal sensed by the microprocessor monitoring the testing results.

Based on the test being performed, sense output 56 may indicate if either a duplicate address response was provided from more than one device 21, 22 or 23, or may indicate if a device exists that failed to sink enough current to drop the voltage enough to signify a proper response value to a weak answer poll message.

In the case of weak answer testing, the sensitivity of comparator 57 is reduced by resistor 33 so that a response received from a device 21, 22 or 23 that is placed to far away on lines 25 and 26 (i.e., beyond the wiring specification 2500 foot maximum distance from a control panel) will not lower the voltage enough to cross the reduced sensitivity of the comparator (i.e., having reduced sensitivity) and will not be sensed at the sense output 56. However, a non-faulty and securely connected device that is wired within the maximum distance requirements will provide a strong enough response that produces a voltage drop that crosses the reduced sensitivity threshold and will be sensed at sense output 56.

Thus, in weak answer device detection and testing, devices that are polled and that do not provide a detectable response are identified as weak answer devices. Such devices may be displayed to an alarm system operator, for example, in order to indicate a problem with the addressed device.

In duplicate address testing mode, the sensitivity of the comparator 57 is reduced so that only responses from more than one of devices 21, 22 and 23 (i.e., response from two or more devices with the same address) will provide enough voltage drop to cross the reduced threshold of the comparator 57 (i.e., reduced sensitivity) and will therefore be sensed at sense output 56. Duplicate responses sink twice as much current as a single response from one device and will therefore provide a detectable or sensed low voltage signal at sense output 56. A response from a single, properly addressed (i.e., non-duplicate) device will not provide a detectable response at sense output 56, because the current sunk by a single device responding will not drop the voltage enough to cross the reduced sensitivity threshold of comparator 57. Duplicate device addresses detected may be displayed to an alarm system operator, for example, in order to indicate a problem during installation of the indicated devices.

It should be understood by those skilled in the art that the circuits of both FIGS. 1 and 2 may be changed in various ways without effecting the overall nature of the invention. For example, the addition or removal of filters may alter the performance of specific circuitry shown, without changing the invention's underlying principles. As such, rearrangements of the circuitry and modifications may be made by those skilled in the art without deviating from the scope of the invention.

Figure 3:
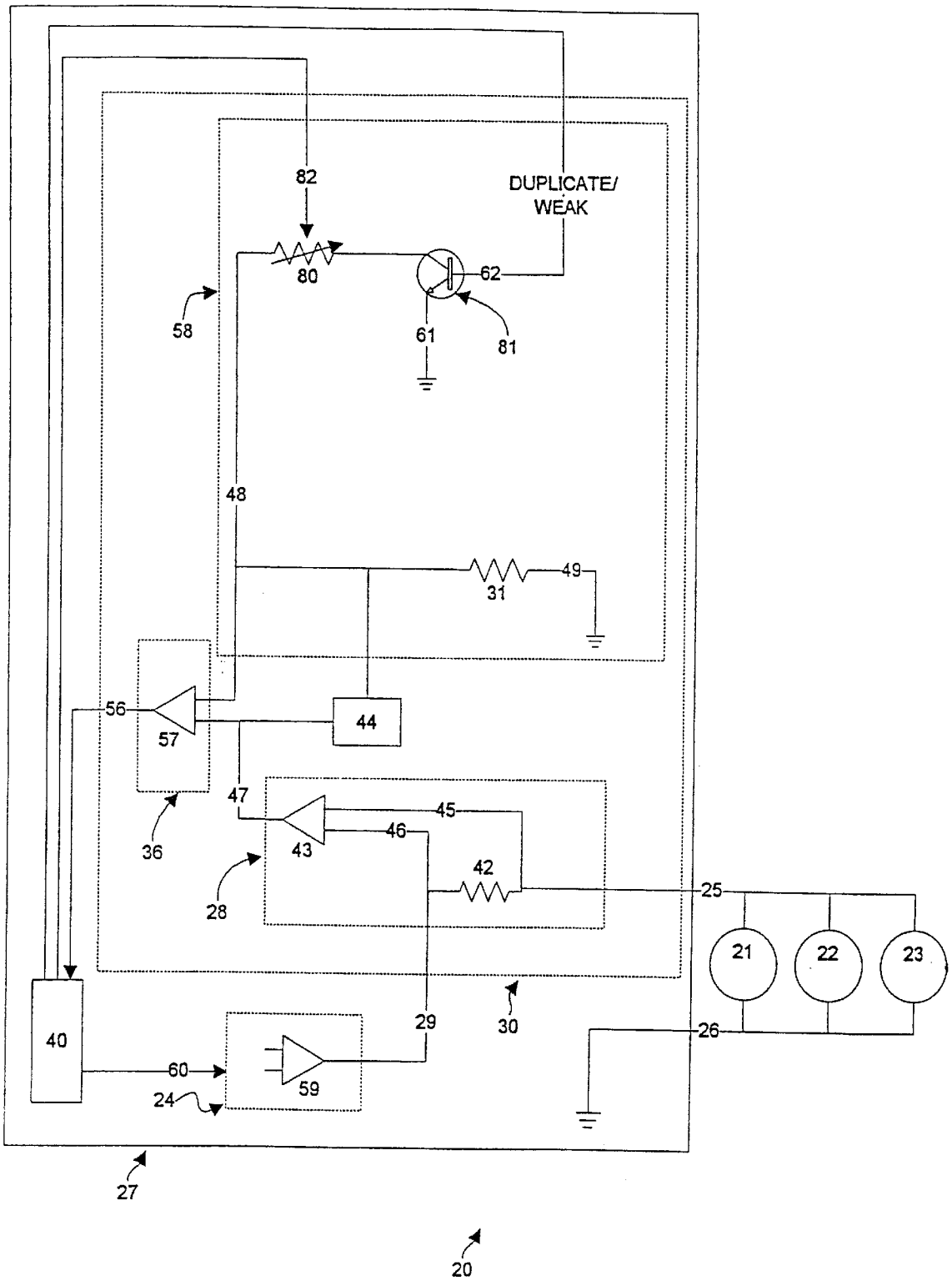
FIG. 3 is an illustration of a variation of the configuration of FIG. 1, showing the use of a variable resistor used to adjust the sensitivity of the receiving circuit.

A variation of the invention shown in FIGS. 1 and 2 is illustrated in FIG. 3. In FIG. 3, a variable resistor 80 is used, instead of having separate first and second selectable resistors 32 and 33 for each test. Variable resistor 80 can be placed in parallel with resistor 31 during either duplicate address or weak answer testing in order to lower the sensitivity of comparator circuit 36. The input 82 into variable resistor 80 can be controlled by the microprocessor 40 in order to select the resistance value used depending on which test is being performed.

For example, if weak answer testing is to be performed, input 82 would be set so that the resistance value of variable resistor 80 is equivalent in value to the resistance of resistor 32 shown in FIGS. 1 and/or 2. If duplicate address testing is to be performed, input 82 would be set so that variable resistor 80 maintained the resistance level of resistor 33 in FIGS. 1 and/or 2. The remainder of the operation of the circuit is the same as FIGS. 1 and 2. Use of a variable resistor requires only one switching mechanism 81, but requires the microprocessor 40 to have knowledge of the required variable resistor settings provided on input 82.

Figure 4:
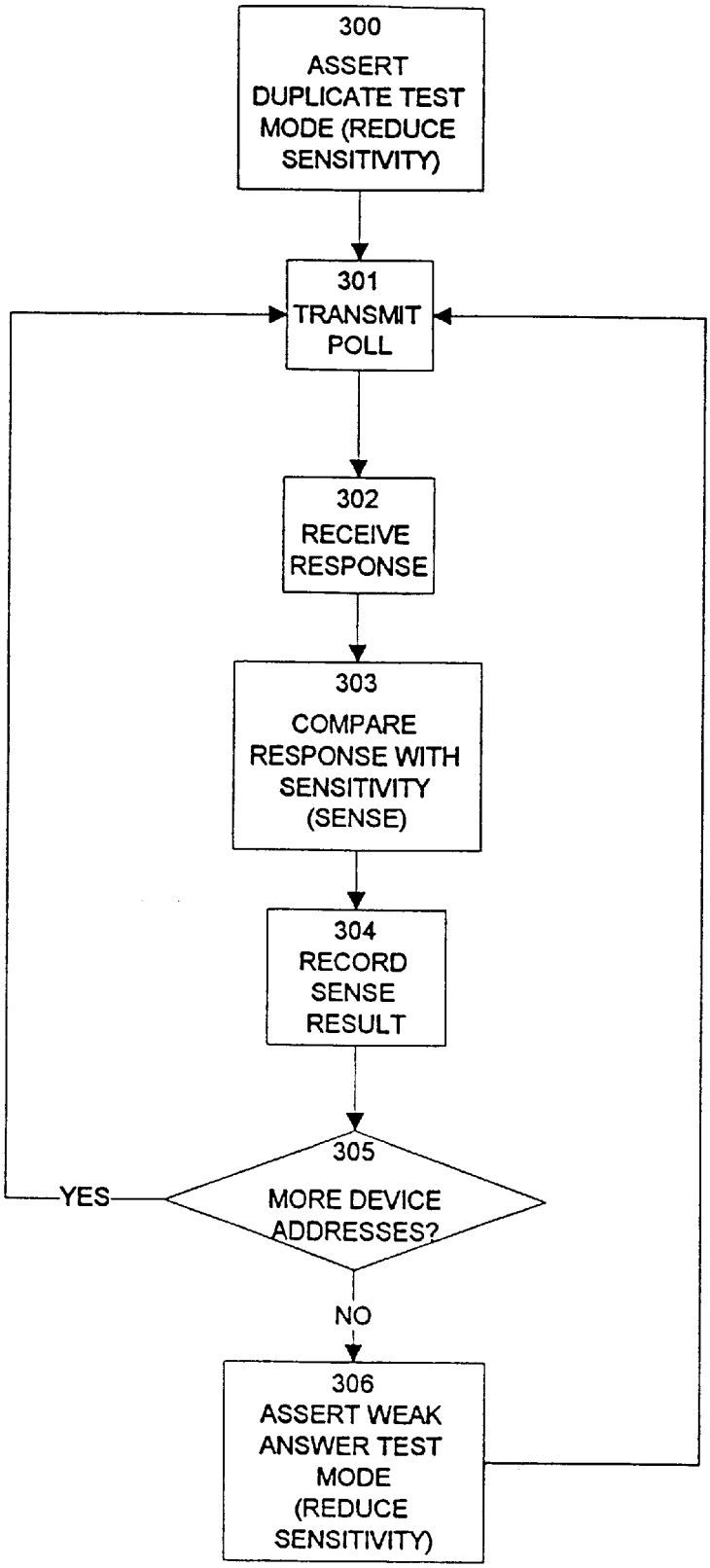
FIG. 4 illustrates an example of processing steps performed by the components of the alarm system circuit according to this invention.

FIG. 4 illustrates an example of processing steps performed according to this invention by the microprocessor 40 within the control panel 27, during duplicate address and/or weak answer testing of all the devices contained on a line. In step 300 of FIG. 4, the microprocessor asserts one of the test modes; either duplicate address or weak answer testing, by activating the appropriate DUPLICATE (55 in FIG. 1) or WEAK (52 in FIG. 1) terminal which reduces the sensitivity of the receiving circuit. Assume for this example that the DUPLICATE terminal is asserted. Next, in step 301, a poll message containing the first address to be tested is transmitted on the line of devices. Step 302 then receives the response from one or more devices on that line. Step 303 compares the response (measurement of the response) with the sensitivity of the receiver that has been reduced. Step 303 essentially senses the response.

Next, the microprocessor in step 304 records the sense result produced from step 303, which indicates whether or not the polled address produced a response that was sensed. In duplicate address testing, a sensed response indicates a duplicate address. Step 305 then determines if there are more addresses to poll on this line (i.e. more devices). If there are, processing returns to step 301. If not, after notification to an alarm system operator of any duplicate addressed devices (which should be fixed before proceeding), step 306 enters the next test mode, which may be, for example, weak answer testing, which again repeats step 301 through 305 in weak answer reduced sensitivity mode, for all device addresses on that line.

According to the processing steps of the invention as shown in FIG. 4, the microprocessor 40 can keep a record for each type of test showing which addresses polled produced sensed responses at sense output 56. During duplicate address testing, the detectable responses that are recorded in step 304 indicate those devices that have duplicate address settings. A similar recording of sensed responses can then be performed for weak answer detection. The weak answer data recorded would indicate those responses that were not detected, thus indicating a wiring or location problem with those devices.

Typically, during the overall testing of the alarm system for device installation problems, as shown by the example processing steps in FIG. 4, duplicate address testing is performed first and the addresses in devices indicated as duplicates are then corrected before proceeding with weak answer testing. Then, weak answer testing can properly be performed. If weak answer testing is performed before duplicate address testing, and it so happens that two or more devices have duplicate addresses, each of these commonly addressed devices will respond to the weak answer poll and the combined responses may potentially sink enough current on line 25 to appear as a single properly wired device for weak answer testing purposes, when in reality, one responding device may have been unsecuredly wired or located too far from the control panel. Thus, to prevent errors during testing, duplicate address testing should be done first, before weak answer testing.

During or after completion of device testing in this invention, the controller (e.g., 40 in FIG. 1) is able to signal to any improperly installed devices on the line to identify themselves for repair purposes. For example, the controller 40 can use the poll transmission circuit 24 to send another signal to the address or addresses of devices which failed either test so that those devices may illuminate or flash an LED on the device. The flashing LED, for example, allows a repair person to easily locate the improperly installed device(s) mounted on a ceiling, in order to correct the wiring, location or address problem.

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

What is claimed is:

1. An apparatus for determining improper installation of a plurality of addressable devices coupled to a line in an alarm system, comprising:

a poll transmission circuit coupled to the line, the poll transmission circuit polling individual addresses of the addressable devices;

a receiving circuit coupled to the line, the receiving circuit detecting a response on the line from at least one addressable device responding to a poll message generated by the poll transmission circuit;

the receiving circuit having a normal sensitivity used for sensing normal non-test communications with devices on the line and a reduced sensitivity that is lowered in relation to the normal sensitivity to detect devices improperly installed on the line, based upon a comparison of the response and the reduced sensitivity, while in a device testing mode.

2. The apparatus of claim 1, wherein when the device testing mode is a duplicate addressing test mode, the receiving circuit is in reduced sensitivity and maintains a threshold of sensitivity defined by a sensitivity reference voltage, to which responses from devices are compared, such that a single response from one device responding to the polling does not cross the threshold of sensitivity but a response from more than one device will cross the threshold of sensitivity and will be determined to be the address of more than one device that is improperly installed in the alarm system.

3. The apparatus of claim 1, wherein when the device testing mode is a weak answer test mode, the receiving circuit is in reduced sensitivity and maintains a threshold of sensitivity defined by a sensitivity reference voltage, to which responses from devices are compared, such that a response from a securely wired and properly located device responding to the polling crosses the threshold of sensitivity but a response from an insecurely wired or improperly located device will not cross the threshold of sensitivity and will be determined to be the address of a device that is improperly installed in the alarm system.

4. The apparatus of claim 1, wherein the receiving circuit further comprises:

a response amplification circuit coupled to the line and receiving a response and providing a measurement of the response;

a sensitivity selection circuit providing an adjustable sensitivity reference voltage that determines the normal and reduced sensitivity of the receiving circuit, the sensitivity reference voltage being a first value when the receiving circuit is operating in normal sensitivity and a second value when the receiving circuit is operating in reduced sensitivity; and a comparator circuit receiving the measurement of the response and receiving the sensitivity reference voltage, the comparator circuit determining, while the receiving circuit is in a device testing mode, if the measurement of the response overcomes the reduced sensitivity of the receiving circuit as defined by the sensitivity reference voltage, such that improper device installation may be detected.

5. The apparatus of claim 4, wherein the sensitivity selection circuit further includes:

a test input;

at least one sensitivity switching mechanism;

a sensitivity reference voltage output, the test input selecting either normal or reduced sensitivity by activating a control of the at least one sensitivity switching mechanism to adjust a voltage on the sensitivity reference voltage output which provides the sensitivity reference voltage that determines the sensitivity of the receiving circuit;

and the comparator circuit further includes:

a response input coupled to the output of the response amplification circuit in order to receive the measurement of the response;

a reference input coupled to the sensitivity reference voltage output in order to receive the sensitivity reference voltage;

a sense output;

the comparator circuit comparing the measurement of the response at the response input with the sensitivity reference voltage at the reference input to produce a sense signal on the sense output if the measurement of the response exceeds a threshold of the comparator circuit when compared against the sensitivity reference voltage;

such that when the test input is activated, the at least one sensitivity switching mechanism causes the receiving circuit to operate in reduced sensitivity by decreasing the sensitivity reference voltage, such that a measurement of the response may produce a sense signal or not, thus allowing the determination to be made of improper device installation.

6. The apparatus of claim 5, wherein the sensitivity reference voltage is derived from a reference current provided to the addressable devices and the receiving circuit by the poll transmission circuit.

7. The apparatus of claim 5, wherein the response amplification circuit further includes:

a reference supply input coupled to the poll transmission circuit, the reference supply input receiving a supply reference voltage from the poll transmission circuit such that the output of the response amplification circuit provides a measurement of the supply reference voltage;

and wherein the receiving circuit further includes a filter circuit comprising:

a filter input coupled to output of the response amplification circuit for receiving the measurement of the supply reference voltage; and a filter output coupled to the sensitivity reference voltage output of the sensitivity selection circuit, the filter circuit providing a continuous average filtered reference voltage at the filter output to be used as a reference voltage supply for the sensitivity selection circuit during both normal and reduced sensitivity operation of the receiving circuit.

8. The apparatus of claim 5, wherein the sensitivity selection circuit further comprises:

a reference resistance value having an output coupled to ground and an input coupled to the sensitivity reference voltage output;

at least one selectable resistance value having an input coupled to the sensitivity reference voltage output and having an output that can be selectively coupled to ground through one of the at least one sensitivity switching mechanism when the test input of that sensitivity switching mechanism is active;

wherein when the at least one sensitivity switching mechanism is inactive, the receiving circuit operates in normal sensitivity, and only the reference resistance value affects the sensitivity reference voltage that determines the sensitivity of the receiving circuit, and when one of the at least one sensitivity switching mechanism is activated via its test input, the at least one selectable resistance value coupled to the at least one sensitivity switching mechanism that is activated and is placed in parallel with the reference resistance value, thus lowering the sensitivity reference voltage present on the sensitivity reference voltage output, thereby reducing normal sensitivity of the receiving circuit to reduced sensitivity; and wherein, if the at least one selectable resistance value is of a first resistance, receiving circuit sensitivity is reduced to detect duplicate addresses of at least two similarly addressed devices coupled to the line, and if the at least one selectable resistance value is of a second resistance, the receiving circuit sensitivity is reduced to detect a weak answer of at least one addressable device coupled to the line.

9. The apparatus of claim 8, wherein the at least one selectable resistance value comprises a first selectable resistance value and a second selectable resistance value.

10. The apparatus of claim 9, wherein:

one of the at least one sensitivity switching mechanism is a duplicate address switching mechanism coupled between ground and an output of the first selectable resistance value and has a duplicate test input;

wherein another of the at least one sensitivity switching mechanism is a weak answer switching mechanism coupled between ground and an output of the second selectable resistance value and has a weak test input; and the comparator circuit further includes a comparator having a first input coupled to the input of the reference resistance value and also to inputs of the first and second selectable resistance values to receive the sensitivity reference voltage and a second input coupled the output of the response amplification circuit to receive the measurement of the response value;

wherein when the duplicate address switching mechanism is activated via the duplicate test input, the first selectable resistance value is electrically coupled between the ground and the first input of the comparator, thus lowering the sensitivity of the comparator, to allow the comparator to compare the measurement of the response with the sensitivity reference voltage to determine if the response from the addressable device polled represents a duplicate response produced from at least two addressable devices responding together for the address polled; and wherein when the weak answer switching mechanism is activated via the weak test input, the second selectable resistance value is electrically coupled between the ground and the first input of the comparator by lowering the sensitivity reference voltage, thus lowering the sensitivity of the comparator, to allow the comparator to compare the measurement of the response value with the sensitivity reference voltage to determine if the response value from the addressable device represents a weak answer for the address polled.

11. The apparatus of claim 10 wherein the response amplification circuit further comprises:

a voltage divider circuit for receiving and dividing response current from a response from the addressable device into first and second divided response voltages; and an amplifier circuit for amplifying difference between the first and second divided response voltages to provide the measurement of the response value.

12. A receiving circuit for detecting improper installation of addressable devices coupled to a line in an alarm system, after an address of one of the addressable devices has been polled and at least one device returns a response in response to the poll, the receiving circuit comprising:

an input for receiving the response;

a sensitivity selection circuit providing a sensitivity reference voltage that is adjustable based upon the selection of at least one test input;

a comparator including:

a first input which couples to the sensitivity selection circuit to receive the sensitivity reference voltage which determines the sensitivity of the comparator;

a second input for receiving a measurement of the response value received at the input of the receiving circuit; and wherein, upon selection of one of the at least one test input, the sensitivity reference voltage is lowered to reduced the sensitivity of the comparator as compared to a normal sensitivity, such that a sense value is produced by the comparator if the measurement of the response value crosses a threshold of the comparator as determined by the sensitivity reference voltage.

13. The receiving circuit of claim 12, wherein the sensitivity selection circuit further includes:

a reference resistance coupled between ground and the first input of the comparator;

at least one selectable resistance selectively engagable, by the at least one test input, between ground and the first input of the comparator, so as to be placed in parallel with the reference resistance with respect to the first input of the comparator, so as to lower the sensitivity of the comparator in order to detect duplicate address responses from addressable device and to detect weak answer responses from devices.

14. The circuit of claim 12, wherein if the sensitivity reference voltage is selected to be of a first voltage, the receiving circuit sensitivity is lowered to produce a sense value indicating that the response represents duplicate addresses.

15. The circuit of claim 12, wherein if the sensitivity reference voltage is selected to be of a second voltage, the receiving circuit sensitivity is lowered to produce a sense value indicating that the response represents a weak answer indicating a faulty connection.

16. The circuit of claim 13, wherein when the first input is engaged with one resistance of the selectable resistance value in combination with the reference resistance value, the one resistance of the selectable resistance value is placed in parallel with the reference resistance value with respect to the first input of the comparator circuit so as to lower the sensitivity of the comparator circuit.

17. The circuit of claim 13, wherein when the first input of the comparator is engaged with a first resistance of the selectable resistance value, the sensitivity of the receiving circuit is such that a response value from a single device will not produce a sense value, but a response from more than one device will produce a sense value.

18. The circuit of claim 13, wherein when the first input of the comparator is engaged with a first resistance of the selectable resistance value, the sensitivity of the receiving circuit is such that a response value from a device securely wired within a predetermined wiring distance to the line will produce a sense value, but a response value from a device un-securely wired to the line will not produce a sense value.

19. The circuit of claim 13, wherein when the first input of the comparator is engaged with a first resistance of the selectable resistance value, the sensitivity of the receiving circuit is such that a response value from a device wired within a predetermined wiring distance to the line will produce a sense value, but a response value from a device wired to the line beyond the predetermined wiring distance will not produce a sense value.

20. A method for detecting improperly wired and improperly addressed devices coupled to a line in an alarm system, comprising the steps of:

in a receiving circuit, lowering the sensitivity of sensing a response value from at least one device;

polling an address of a device on the line with a poll sent from a poll transmission circuit;

in the receiving circuit, receiving a response value on the line in response to the poll; and determining if a measurement of the response value crosses a threshold of the receiving circuit having the lowered sensitivity as an indication of the presence of at least one improperly installed device on the line.

21. The method of claim 20, wherein the steps of lowering, polling, receiving and determining are first performed in a duplicate address testing mode having the sensitivity of the receiving circuit lowered to a duplicate address testing threshold, and then performing each of the steps again in a weak answer testing mode having the sensitivity of the receiving circuit lowered to a weak answer testing threshold.

22. The method of claim 20, wherein if the sensitivity is lowered to cause the receiving circuit to maintain a first threshold, the receiving circuit indicates a duplicate address of at least two devices coupled to the line, each having an address of the poll.

23. The method of claim 20, wherein if the sensitivity is lowered to cause the receiving circuit to maintain a second threshold, the receiving circuit indicates a device coupled to the line having the address of the poll is securely wired to the line.

24. The method of claim 20, wherein if the sensitivity is lowered to cause the receiving circuit to maintain a second threshold, the receiving circuit indicates a device coupled to the line having the address of the poll is wired within a maximum allowable distance on the line.

25. The method of claim 20, further including the step of producing a sense value on a sense output of the receiving circuit which indicates the presence of at least one improperly installed device on the line.

26. The method of claim 20, further including the step of signaling to the at least one improperly installed device on the line to identify itself for repair purposes.

27. The method of claim 20, wherein the sensitivity of the receiving circuit is lowered by providing a selectable resistance value in combination with a reference resistance value to lower a sensitivity reference voltage supplied as input to a comparing circuit which determines the sensitivity of the receiving circuit.

28. The method of claim 27, wherein if the selectable resistance value is a first resistance, the receiving circuit produces a sense value from the comparing circuit that indicates a duplicate address of at least two devices coupled to the line, each having an address of the poll.

29. The method of claim 27, wherein if the selectable resistance value is a second resistance, the receiving circuit produces a sense value from the comparing circuit that indicates a device coupled to the line having the address of the poll is securely wired to the line.

30. The method of claim 27, wherein if the selectable resistance value is a second resistance, the receiving circuit produces a sense value from the comparing circuit that indicates a device coupled to the line having the address of the poll is wired within a maximum allowable distance on the line.

31. The method of claim 27, wherein the selectable resistance value is placed in parallel with the reference resistance value in order to lower the sensitivity of the receiving circuit.

32. An alarm system including an integrated circuit for detecting improperly wired and improperly addressed devices, comprising:

a plurality of devices connected to a line;

a control panel coupled to the line;

a poll transmission circuit within the control panel coupled to the line and having a means for polling addresses of the plurality of devices; and a receiving circuit within the control panel coupled to the line and having a means for lowering a sensitivity of detecting and measuring a response value returned from at least one device on the line in response to a poll, such that while the sensitivity of the receiving circuit is lowered, if in a duplicate address testing mode and more than one response value is sensed, a duplicate address on the line is detected, and if in a weak answer testing mode and only one response value is sensed, the response value indicates a device properly wired to the line in the alarm system.

* * * * *